United States Patent [19]

Guichard

[11] Patent Number: 4,654,619

[45] Date of Patent: Mar. 31, 1987

[54] MODULE FOR THE PROTECTION OF MULTIWIRE LINES AGAINST OVERVOLTAGES

[75] Inventor: Francois M. Guichard, Paris, France

[73] Assignee: Compagnie Industrielle de Tubes et Lamps Electriques Citel, Isst-les-Moulineaux, France

[21] Appl. No.: 760,566

[22] Filed: Jul. 30, 1985

[30] Foreign Application Priority Data

Feb. 21, 1985 [FR] France ..... 85 02488

[51] Int. Cl.[4] ..... H01H 39/00

[52] U.S. Cl. ..... 337/32; 337/31; 361/124

[58] Field of Search ..... 337/31, 32, 33, 34, 337/28, 29; 361/119, 124, 125

[56] References Cited

U.S. PATENT DOCUMENTS 4,086,648 4/1978 Hines et al. ..... 337/32

4,288,832 9/1981 Saligny ..... 337/32

*Primary Examiner*—H. Broome

*Attorney, Agent, or Firm*—Brisebois & Kruger

[57] ABSTRACT

A module for the protection of multiwire lines against overvoltages comprises a casing formed by a receptacle and a terminal carrier plate. The terminal carrier plate comprises a pair of terminals for each wire of the multiwire line, and an earth terminal. Overvoltage diverters are connected to said wires and each have a first electrode soldered to a U link which connects, the two terminals of each pair of terminals, and a second electrode soldered to a transverse bar itself soldered to an extension of the earth terminal. The subassembly connected to the terminal carrier plate is disposed within the receptacle and is potted in a plastic potting substance. This module may be used for the protection of telephone lines.

13 Claims, 6 Drawing Figures

MODULE FOR THE PROTECTION OF MULTIWIRE LINES AGAINST OVERVOLTAGES

FIELD OF THE INVENTION

The present invention concerns a module for the overvoltage protection of multiwire lines, and two wire lines in particular.

PRIOR ART

It is frequently necessary to protect an electric line against overvoltages, in particular in telephone and data processing technologies where it is necessary to protect expensive electronic components. To do this, it is known to use overvoltage diverters which are shunt-connected on the wire to be protected, each overvoltage protector comprising one electrode electrically connected to the wire and another electrode electrically connected to earth. If an overvoltage is produced in the wire, an arc is established in the overvoltage diverter and the current flows to earth. Some of these overvoltage diverters are fitted with a short circuit device which is triggered when the quantity of current flowing to earth is unduly high. In particular these short circuit devices operate with fuse elements. An overvoltage diverter of this type has already been disclosed in French Patent Application No. 84-18981 (inventors FRANCOIS GUICHARD and JACQUES CHOLLEY) filed on the Dec. 12, 1984 by the assignees of the present applicant. Such an overvoltage diverter comprises an external cylindrical metallic shell connected to earth and an axial electrode connected to the wire in which overvoltages are to be avoided. The axial electrode is retained in relation to the outer shell by a leak-proof insulator; the short circuit device is disposed outside the external shell of the overvoltage diverter and within a metallic cup joined to the external shell, the cup being traversed by the axial electrode of the overvoltage diverter but insulated from it and enclosing a conducting fuse element.

The manufacture of a module for the protection of multiwire lines poses a problem of complexity, solely by reason of the many elements which occur in the making of such a module. It suffices for this purpose to refer to U.S. Pat. No. 4,434,449 (LARRY W. DICKEY) to find that the casing of such a protective module contains a sufficiently high number of components for its manufacture to be complex and expensive and for its reliability to be doubtful, in particular by reason of the presence of springs which are used to maintain contact within the protective module.

OBJECTS OF THE PRESENT INVENTION

It is an object of the present invention to propose a much simpler structure for a protective module, by making a soldered subassembly which comprises the discharging means to be installed in the module and the terminal carrier plate of the module.

It is a further object to provide such a module in which, for the discharging means, indiscriminate use can be made of either bipolar overvoltage diverters each connected to one wire of the line to be protected, or tripolar overvoltage diverters capable of ensuring the protection of the two wires of the line. Like the bipolar overvoltage diverters disclosed in said French Patent Application No. 84-18 981, such tripolar overvoltage diverters can possibly comprise short circuit means disposed outside the external shell of the overvoltage diverter and within a metallic cup joined to said external shell.

SUMMARY OF THE PRESENT INVENTION

The present invention therefore provides a new industrial product constituted by a module protecting multiwire lines against overvoltages and comprising, in an insulating casing, for each one of the wires of the line one lead-in and one lead-out connection between which there is connected one of the poles of a discharging means whose other pole is earthed, the casing comprising an odd number of connecting terminals of which one pair is allocated to each of the wires of the line, the last terminal being the earth terminal connected to the earth pole(s) of the discharging means, characterised in that the insulating casing comprises a receptacle which is open on one of its sides with said open side of the receptacle being closed by a terminal carrier plate which is fitted on the receptacle, the lead-in and the lead-out terminals of one and the same wire and interconnected on the inside of the terminal carrier plate via a U link, the earth terminal is extended on the internal side of the terminal carrier plate to constitute a support fitting whereon there is (or are) soldered the earth pole (or poles) of the discharging means, and the other poles of said discharging means and soldered to the U links so that the terminal carrier plate and the discharging means constitute a mono-bloc subassembly.

In a preferred embodiment, the terminal carrier plate is catch-engaged on the receptacle; the insulating casing is at least partly filled with a plastic potting substance which, on the one hand, pots the elements joined to the terminal carrier plate and, on the other hand, ensures the seal of the joints between the said terminal carrier plate and the receptacle; if the module is intended for the protection of a two wire line, the axes of the lead-in and lead-out connections connected to each of the two wires of the line are advantageously in parallel planes equidistant from the earth terminal; and the discharging means comprises at least one short circuit means, the said short circuit being triggered, when the external shell of of the said discharging means is heated, by the melting of a fuse element. Provision may advantageously be made for the short circuit means to be disposed outside the external shell of the discharging means and within a metallic cup joined to the external shell, said cup being traversed by an electrode but being insulated from it and enclosing a conducting fuse element, a seal being disposed between the cup and said electrode to avoid any penetration of the plastic potting substance into the cup.

In a first variant of the embodiment of the module according to the invention, the discharging means comprises two bipolar overvoltage diverters, for each of which a first electrode forms the pole joined to a U link and a second electrode forms the earth pole; the connection between the support fitting and the second electrodes of the two overvoltage diverters is obtained by a transverse conducting bar which is fixed by soldering to both the second electrodes and to the support fitting; the axis of the support fitting is disposed in relation to a plane passing through the axis of the transverse bar and parallel to the axis of the support fitting on the side without the second electrodes.

In a second variant of the embodiment of the module according to the invention the discharging means is constituted by a tripolar overvoltage diverter, whose central portion of the external shell forms the earth pole and whereof each end of the external shell comprises one electrode soldered to a U link of the module; the support fitting is (elbow) bent at its end, the central portion of the tripolar overvoltage diverter being a metallic cylinder and being soldered to the bent portion of the support fitting; one of the electrodes of the overvoltage diverter is substantially rectilinear, whilst the other has the shape of a U whose one side is longer than the other.

In the module in accordance with the invention, the subassembly integral with the terminal carrier plate is, as indicated above, advantageously potted in a plastic insulating substance. It is, in point of fact, extremely easy, when the monobloc subassembly has been made which comprises all the electric elements of the module, to place the receptacle so that its open side should be turned upwards, to pour into it a liquid plastic insulating substance, to position the—terminal carrier plate on the open side of the receptacle by causing the elements mechanically joined thereto to be immersed in the liquid plastic substance, then to agitate the receptacle closed in this way to some extent for the liquid plastic potting substance to come to pot on the one hand, all the—elements of the monobloc subassembly, and on the other hand, to enter into the joints between the terminal carrier plate and the receptacle. When the plastic potting substance has been solidified by cooling or by polymerisation, its presence in the joints between the terminal carrier plate and the receptacle ensures a perfect seal for the casing and its presence around all the components of the monobloc subassembly ensures a perfect integrity of the soldered connections and a reliable functioning of the protective module. It is clear that it is not necessary to fill the receptacle completely with the liquid plastic material; this is the reason why, after the closing of the receptacle by the positioning of the terminal carrier plate, it is necessary to shake the module somewhat to ensure the distribution of the plastic material within the whole of the receptacle; the receptacle may, in particular, be turned so that the plastic material as a whole comes into contact with the terminal carrier plate so as to duly ensure the seal of the module in relation to the outside, this position, however, not being maintained very long so as to prevent the liquid plastic substance from emerging via the junction zones existing between the terminal carrier plate and the receptacle. Whilst it is more economic to use only a small liquid plastic potting substance, there is, nevertheless, nothing to prevent a complete filling of the receptacle being considered, for instance by injecting a liquid plastic substance inside the receptacle after the terminal carrier plate has been placed into position.

It is preferable for the overvoltage diverters used in the making of the protective module according to the invention to comprise a short circuit action triggered on heating of the external shell of the overvoltage diverter by the melting of a fuse element. In point of fact, in this case, if the overvoltage on a wire is maintained for a prolonged period, the external shell of the overvoltage diverter does heat which causes the earthing of the corresponding wire. This way of proceeding makes it possible to avoid any risk of deterioration of the electronic components situated downline from the protective module and to signal the existence of an anomaly in the supply: in point of fact, the earthing of one of the wires of the line corresponds to a supply breakdown of the circuit to which the protected line is connected which, in order to resume a normal service, makes it necessary to replace the module protecting the line. To obtain this short circuit action, one can advantageously use an overvoltage diverter such as the one that has been described in detail in the French Patent Application No. 84-18 981 filed on the Dec. 12, 1984, the content of this patent application being incorporated in the present description by way of reference.

BRIEF DESCRIPTION OF THE DRAWINGS

In order that the present invention may more readily be understood there will now be described two embodiments, represented in the attached drawings by way of purely illustrative and non-restrictive example.

In these drawings:

Referring to FIGS. 1 to 4, it will be seen that 1 designates the receptacle of the protective module in accordance with the invention. Receptacle 1 has a rectangular parallelepiped shape and has an open end 2 and an opposite back panel 3. A mount 4 is placed on back panel 3 to hold the module in position in installations where it is to be used. Receptacle 1 is made of an electrically insulating plastic material. Around the open side 2 are four catch engagement tabs 5.

Figures 1, 4:
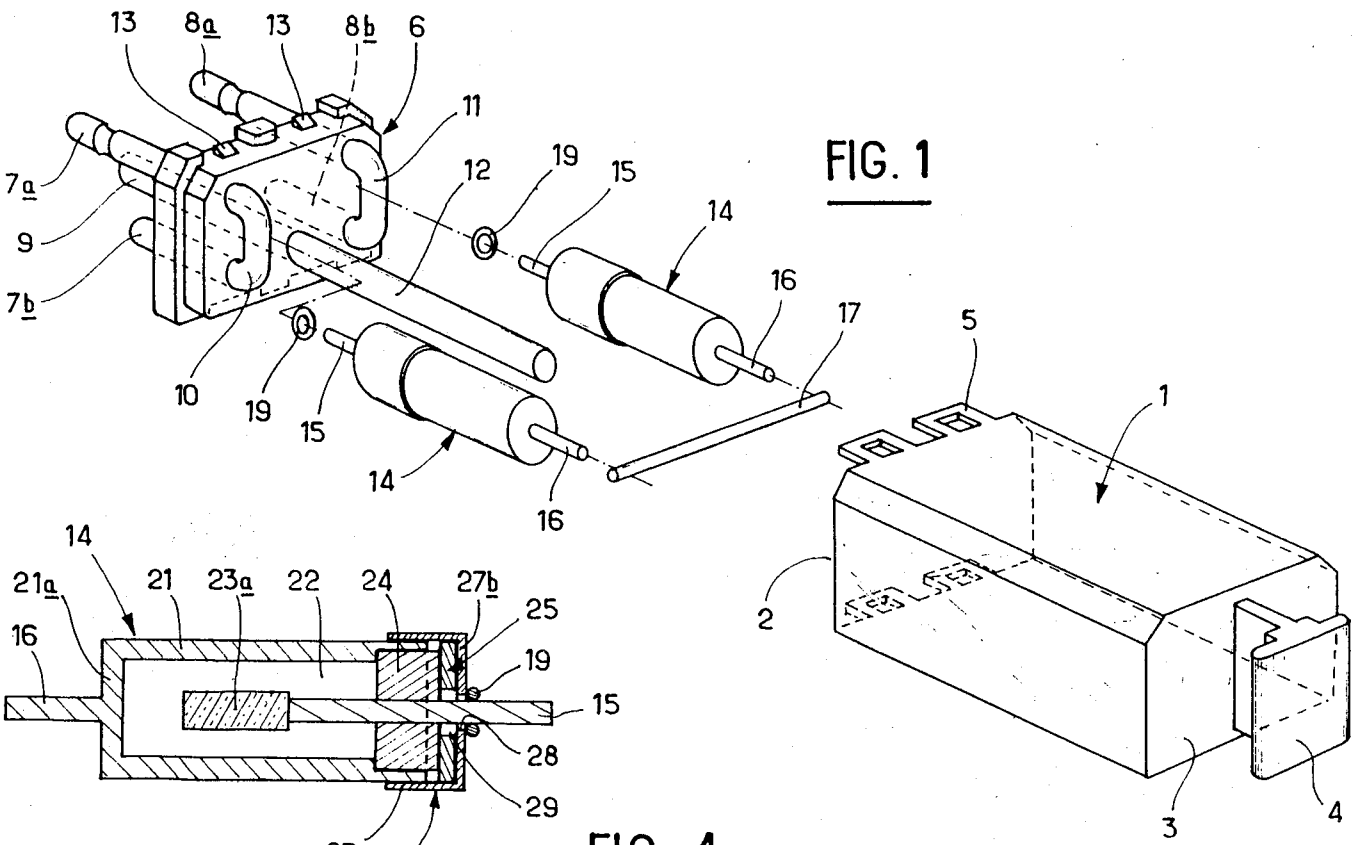
FIG. 1 is an exploded perspective of the elements constituting a protective module in accordance with the invention, intended for a two wire line and using two bipolar overvoltage diverters.
FIG. 4 is an axial cross section of the overvoltage protector used to make the protective module of FIGS. 1 to 3.

The protective module according to the invention also comprises a terminal carrier plate generally designated 6. The terminal carrier plate 6 comprises five terminals: the first two, *7a, 7b* respectively, constitute the lead-in and lead-out connections of the first wire to be connected to the protective module; the two following ones, *8a, 8b* respectively, constitute the lead-in and lead-out connections of the second wire connected to the protective module; the central fifth terminal 9 is earthed. Terminals *7b, 8b* and 9 have parallel axes; the plane defined by axes *7b* and *8b* is perpendicular to the planes defined by the axes of terminals *7a, 7b* on the one hand and the axes of terminals *8a, 8b* on the other hand. Terminals *7a, 7b* on the one hand and *8a, 8b* on the other hand are respectively interconnected by two U links 10 and 11 made of a conducting metal; the U links 10 and 11 project on the opposite side of the terminal carrier plate 6 from that having the terminals *7a, 7b, 8a, 8b* and 9. The side of the terminal carrier plate where the U links 10 and 11 are located is called "the internal side" of the terminal carrier plate, since it is intended to face the inside of the receptacle 1. Terminal 9 passes through the terminal carrier plate 6 from one side to the other and projects on the internal side of the terminal carrier plate to constitute a pin-shaped support fitting 12. The length of support fitting 12 is slightly shorter than the length of receptacle 1 measured between the open side 2 and the back panel 3. It is clear that terminals 7*a*, 7*b* and the U link 10, on the one hand, as well as terminals 8*a*, 8*b* and U link 11, on the other hand, can be obtained by bending the same pin, and then moulding the terminal carrier plate 6 onto the said bent pins and on the earth terminal 9–12.

The terminal carrier plate 6 is intended to be fitted to the receptacle 1 by catch engagement. For this purpose, it comprises, on its edge, catches 13 each intended to be inserted in one of the catch engagement tabs 5 of receptacle 1 by simple elastic deformation of the said tabs as the terminal carrier plate 6 is positioned on the receptacle 1 to close the open end 2.

The terminal carrier plate 6 is fitted with two bipolar overvoltage diverters 14, each of which comprises a first electrode 15 intended to be connected to the wire to be protected and a second electrode 16 intended to be connected to earth.

The first electrodes 15 are soldered on the edge zones of U links 10 and 11 which face each other. The axes of overvoltage diverters are initially parallel and parallel to the plane formed by the axes of terminals 7*b*, 8*b*.

The second electrodes 16 of the two overvoltage diverters are soldered to a transverse bar 17 whose axis is perpendicular to the axis of support fitting 12. The location of soldering of the first electrodes 15 on the U links 10 and 11 has been chosen so that if the transverse bar 17 is soldered underneath electrodes 16, the bar 17 comes into contact with the upper generatrix of the support fitting 12 which allows it to be soldered on the support fitting 12. One has thus obtained a monobloc assembly which comprises the terminal carrier plate and the two overvoltage diverters 14, with the two said electrodes 16 connected to earth terminal 9, and the two first electrodes 15 respectively connected to the two wires of the line to be monitored via terminals 7*a*, 7*b* on the one hand and 8*a*, 8*b* on the other hand.

Figure 3:
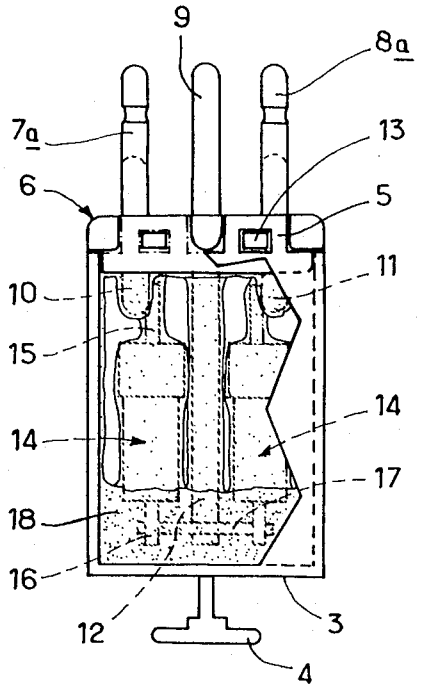
FIG. 3 represents the module of FIG. 2 in plan, with a portion cut away, with the plastic potting substance in place.
Figure 2:
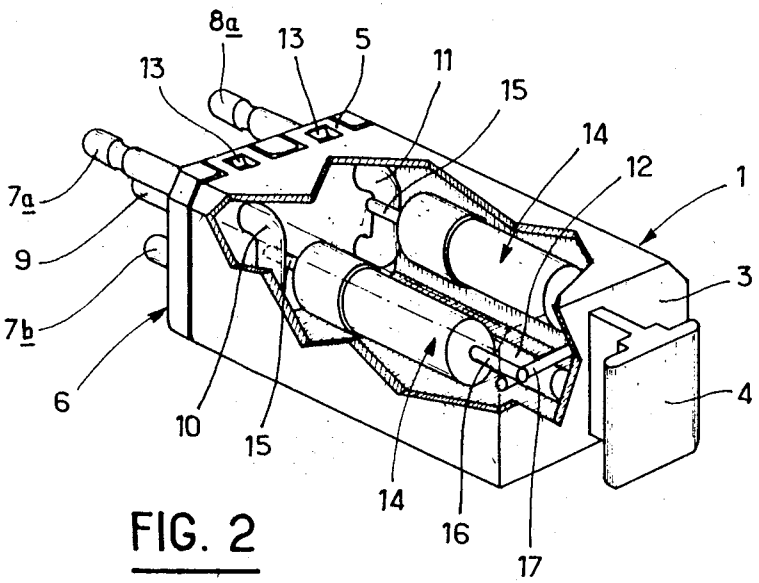
FIG. 2 is a perspective of the module of FIG. 1 with a portion cut away after the terminal carrier plate has been positioned on the receptacle but without the plastic potting substance.

When the monobloc subassembly described above has been made, the receptacle 1 is positioned so that its open end 2 uppermost as in FIG. 3, and this receptacle 1 is filled to about one third of its capacity with an electrically insulating thermoplastic substance heated to a temperature above its melting point. The terminal carrier plate 6 is then catch-engaged on the receptacle 1 to close the previously open end 2 of the receptacle. The module constituted in this way is then upended for some seconds to allow the plastic potting substance 18 to fill the joints between the terminal carrier plate 6 and the corresponding edge of the receptacle 1, and it is then returned to the initial position. During this upending, the plastic potting substance enters the joints to a sufficient extent, so that when it solidifies on cooling, it perfectly seals the module in relation to the outside. Moreover, during this upending the plastic substance has potted all the elements situated within receptacle 1 and after solidification, the plastic potting substance consolidates the soldered unit constituted by the monobloc subassembly.

FIG. 4 shows in cross section, the overvoltage diverter 14 used to constitute the protective module described above. The overvoltage diverter 14 comprises an external metallic shell 21 delimiting an enclosed space 22 containing an inert gas under low pressure; this gas can be argon and the pressure is much lower than atmospheric pressure. The shell 21 is constituted by a metallic cylinder comprising a transverse back panel 21*a* in whose central zone there is located an integral external pin 16 which constitutes the second electrode of the overvoltage diverter. A metallic pin 15 is disposed co-axially within the shell 21 and constitutes the first electrode of the overvoltage diverter. The pin 15 has its end 23*a* within the shell 21 slightly larger in diameter than the rest of the pin.

An insulating glass bead 24 is disposed between the pin 15 and the external shell 21 to close the open end of the shell.

The external short circuit means of the overvoltage diverter 14 comprise a fuse element 25 in the form of a washer disposed inside a cup 27. The external periphery of the washer 25 is in contact with the internal surface of the cup 27 which ensures the centering of the washer. The cup 27 comprises a cylindrical wall 27*a* surrounding the external shell 21 against which it is tightly held to establish an electric contact. The cup 27 moreover comprises a transverse bottom 27*b* provided with an opening 28 to pass the metallic pin 15. The edge of this opening 28 surrounds pin 15 at a given radial distance from the pin 15 so that the cup 27 is normally electrically insulated from the pin. An annular space 29 is defined between the transverse bottom 27*b* of the cup 27 and the adjacent face of the glass bead 24; the fuse washer 25 is disposed in this annular space 29. As has been seen, the first electrode 15 is normally insulated from the second electrode 16 of the overvoltage diverter. If an overvoltage occurs on the wire connected to the electrode 15, an arc is established between the portion 23*a* of the first electrode 15 and the external shell 21, which allows the loads to be discharged to earth. If this arc is maintained for too long the external shell 21 is heating up and the fuse washer 25 melts within the annular space 29. It follows from this that a short circuit occurs between the electrodes 15 and 16 of the overvoltage diverter 14, and hence the wire connected to the first electrode 15 in the protective module according to the invention becomes earthed.

In the protective module according to the invention, since the monobloc subassembly is intended to be potted in a liquid plastic substance, the said plastic potting substance should be prevented from being capable of entering into cup 27 by closing off the annular space which separates the cup 27 from electrode 15, preferably by means of an annular seal, such as an O ring 19 used in this instance.

Figure 5:
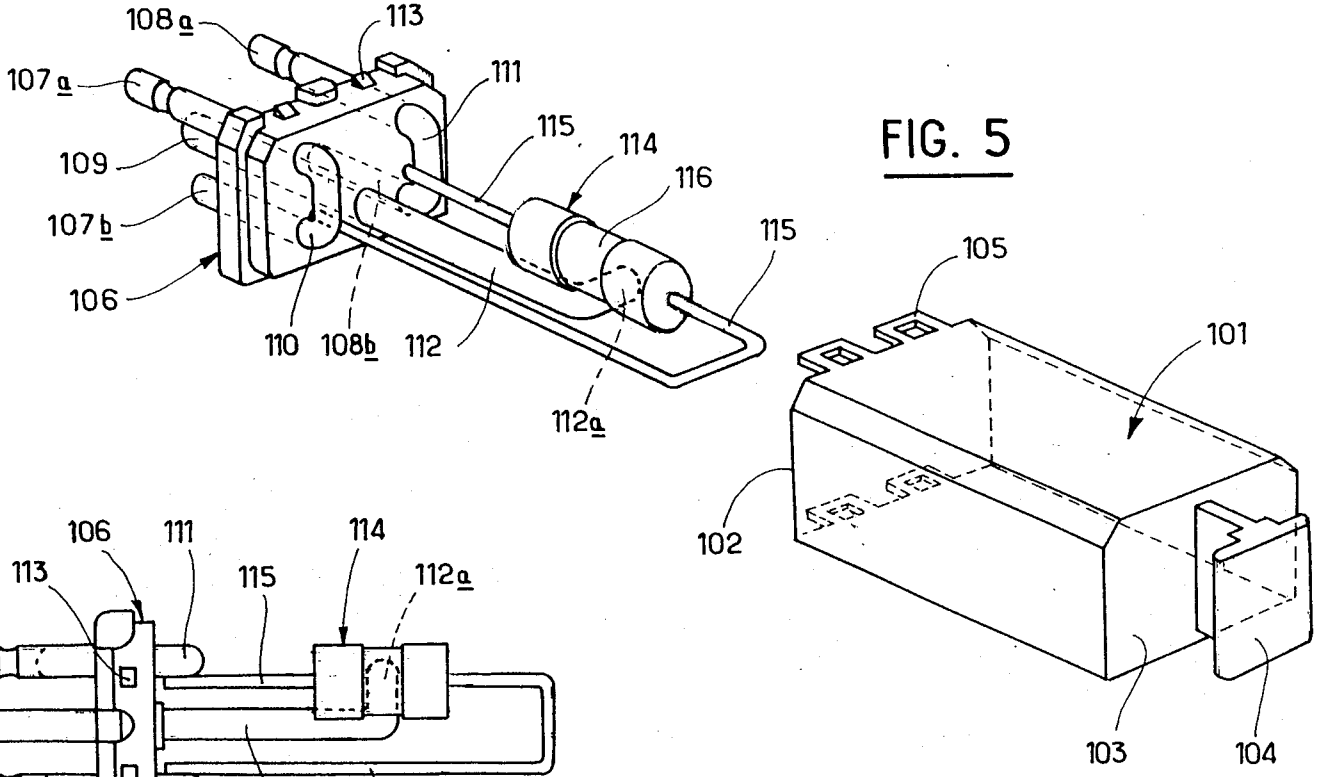
FIG. 5 is a perspective of the elements which constitute another protective module in accordance with the invention intended for a two wire line and using a tripolar overvoltage diverter.
Figure 6:
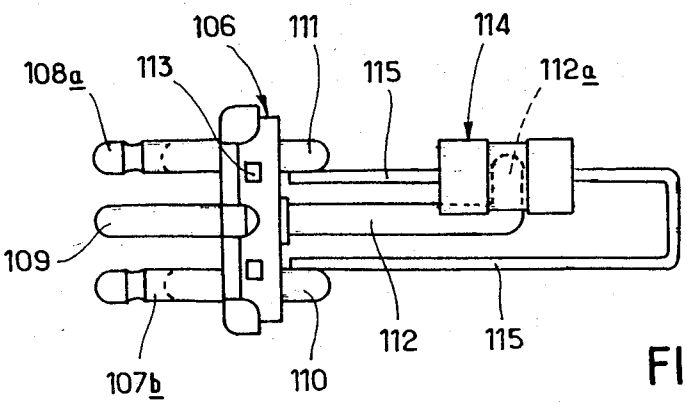
FIG. 6 represents a plan view of the monobloc subassembly constituted by the terminal carrier plate and the tripolar overvoltage diverter used for the making of the module of FIG. 5.

FIGS. 5 and 6 show a second embodiment of the protective module in accordance with the invention. In this embodiment, a single tripolar overvoltage diverter 114 is used as the discharging means comprising an earth pole constituted by the metallic cylinder 116 which forms the central portion of the external shell of the overvoltage diverter and two end electrodes 115 disposed symmetrically in relation to the earth pole 116. This overvoltage diverter 114 comprises, for each of the electrodes 115, an external short circuit device identical with that which has been previously described for the overvoltage diverter 14; this external short circuit device will therefore not be described again in detail.

In the module of this embodiment, most of the elements are identical with those which have been previously described for the module of FIGS. 1 to 4. The corresponding elements of FIGS. 5 and 6 have therefore been designated by the reference numbers of those elements in FIGS. 1 to 4 but increased by 100.

Receptacle 101 used in this second embodiment is strictly identical with the receptacle 1 described above. It has an open end 102 opposite a back panel 103, and there is a mounting 104 on the back panel 103; the open side 102 is again edged by four catch-engagement tabs 105.

The module of this second embodiment comprises a terminal carrier plate 106 identical with the terminal carrier plate 6. The terminal carrier plate 106 comprises five terminals: the first two 107*a*, 107*b* respectively constitute the lead-in and the lead-out connection of the first wire to be connected to the protective module; the two following ones 108*a*, 108*b* constitute respectively the lead-in and the lead-out connection of the second wire to be connected to this protective module; the fifth terminal 109 is earthed. U links 110 and 111, respectively, connect the terminals 107*a*, 107*b* and the terminals 108*a*, 108*b*, on the rear side of the terminal carrier plate. Earth terminal 109 passes from one side of the terminal carrier plate 106 to the other and projects on the internal (or rear) side of the said terminal carrier plate to constitute a support fitting 112 in the form of a pin whose end is bent at right angles to form an arm 112*a*. The metallic cylinder 116 which constitutes the central portion of the tripolar overvoltage diverter 114 is soldered to the bent arm 112*a*. The axis of the overvoltage diverter 114 is substantially parallel to the axis of the support fitting 112 and it passes near the U link 111. One of the electrodes 115 of the single overvoltage diverter 114 is substantially rectilinear and is soldered to U link 111. The other electrode 115 of the overvoltage diverter has the shape of a U with one of its sides much longer than the other, the end of the longer side of the U being soldered to the U link 110. The plane defined by the two electrodes 115 is parallel to the plane defined by the bent arm 112*a* and the axis of pin 109, these two planes being perpendicular to the planes defined by terminals 107*a*, 107*b* on the one hand and 108*a*, 108*b* on the other hand. As has been indicated for the first embodiment, the monobloc subassembly formed by the terminal carrier plate 106 and the tripolar overvoltage diverter 114 is positioned in the receptacle 101 after this receptacle has been filled to about one third of its capacity with an electrically insulating thermoplastic substance brought above its melting point. The module is then closed, by catch-engagement of the terminal carrier plate 106 on receptacle 101, and potting with the plastic substance continues, as has been indicated in detail for the first embodiment.

The advantages offered by the module of FIGS. 5 and 6 are the same as those offered by the module of the first variant.

It shall be duly understood that the embodiments described above are in no way restrictive, and may give rise to any desirable modification without thereby departing from the scope of the invention.

I claim:

1. In a module for the protection of multiwire lines against overvoltages, such module comprising:

(a) an insulating casing;

(b) for each one of the wires of the line to be protected one lead-in connection and one lead-out connection;

(c) discharging means having first pole means connected to the lead-in and lead-out connections of said wires, and second pole means connected to earth, said insulating casing comprising an odd number of connection terminals constituting, respectively, said lead-in and lead-out connections and an earth terminal for said second pole means;

the improvement wherein:

(d) the insulating casing comprises a receptacle open on one of its sides, a terminal carrier plate fitted on said receptacle to close said open side thereof;

(e) a U link projects from said terminal on the inside of said receptacle to interconnect the lead-in terminal connections and lead-out terminal connections of one and the same wire;

(f) the earth terminal being extended internally of said receptable to constitute a support fitting secured to the terminal carrier plate, said earth terminal being soldered to said second pole means of the discharging means; and (g) said first pole means of the discharging means being soldered to said U links whereby the terminal carrier plate and the discharging means constitute a monobloc subassemby within the receptacle.

2. A module according to claim 1, including catch-engagement means securing said terminal carrier plate to said receptacle.

3. A module according to claim 1, adapted to protect a two wire line, wherein the axes of the lead-in terminals connected to each one of the wires of the line define a first plane and the axes of the corresponding lead-out terminals define a second plane parallel to said first plane, said parallel first and second planes being equidistant from the earth terminal.

4. A module according to claim 1, wherein said discharging means includes short circuit means, having a fuse element, the short circuit action being tirggered, on heating of said discharging means, by the melting of a fuse element.

5. A module according to claim 1, wherein said discharging means comprises two bipolar overvoltage diverters, each of which includes a first electrode forming said first pole means connected to a U link and a second electrode forming said second pole means.

6. A module according to claim 5, including a transverse conducting bar soldered both to said two second electrodes and to said support fitting to connect said support fitting to said second electrodes.

7. A module according to claim 6, wherein said support fitting has an axis disposed, in relation to a plane which passes through the axis of said transverse bar and is parallel to the axis of the support fitting, on the side of said plane opposite that where second electrodes are arranged.

8. A module according to claim 1, wherein said discharging means comprise a tripolar overvoltage diverter having an external shell with a central portion which forms the second pole means, and has at each end of said external shell an electrode constituting part of said first pole means and soldered to a said U link of the module.

9. A module according to claim 8, wherein said support fitting is bent at its end, and wherein said central portion of the tripolar overvoltage diverter is a metallic cylinder soldered to said bent portion of the support fitting.

10. A module according to claim 9, wherein one of said end electrodes of the tripolar overvoltage diverter is substantially rectilinear and the other has the shape of a U of which one side is longer than the other.

11. In a module for the protection of multiwire line against overvoltages, such module comprising:

(a) an insulating casing;

(b) a lead-in connection and a lead-out connection for each one of the wires of the lines to be protected;

(c) discharge means having first pole means connected to the lead-in and lead-out connections of said wires, and second pole means connected to earth, said insulating casing comprising an odd number of connection terminals constituting, respectively, said lead-in and lead-out connections and an earth terminal for said second pole means;

the improvement wherein:

(d) the insulating casing comprises a receptacle open on one of its sides, a terminal carrier plate fitted on said receptacle to close said open side of the receptacle;

(e) a U link projects from said terminal on the inside of said receptacle to interconnect the lead-in terminal connections and lead-out terminal connections of one and the same wire;

(f) the earth terminal being extended internally of said receptacle to constitute a support fitting secured to the terminal carrier plate, said earth terminal being soldered to said second pole means of the discharging means;

(g) said first pole means of the discharging means being soldered to said U links whereby the terminal carrier plate and the discharging means constitute monobloc subassembly within the receptacle, and (h) an insulating plastic potting substance at least partly filling said insulating casing and potting said U links, said support fitting, and said discharging means joined to the terminal carrier plate, and sealing the connection between said terminal carrier plate and said receptacle.

12. A module according to claim 11, wherein the discharging means has an external shell, an electrically conducting fuse element, a metallic cup joined to said external shell, an electrode traversing said cup but insulated from the cup and containing said conducting fuse element and, a seal disposed between said cup and said electrode to prevent penetration of the plastic potting substance into the cup, said fuse elements defining short circuit means being disposed outside said external shell and within said cup, and the short circuit action being triggered, on heating of said discharging means, by the melting of a fuse element.

13. In a module for the protection of multiwire lines against overvoltages, such module comprising:

(a) an insulating casing;

(b) a lead-in connection and a lead-out connection for each one of the wires of the lines to be protected;

(c) discharge means having first pole means connected to the lead-in and lead-out connections of said wires, and second pole means connected to earth, said insulating casing comprising an odd number of connection terminals constituting, respectively, said lead-in and lead-out connections and an earth terminal for said second pole means;

the improvement wherein:

(d) the insulating casing comprises a receptacle open on one of its sides, a terminal carrier plate fitted on said receptacle to close said open side of the receptacle;

(e) a U link projects from said terminal on the inside of said receptacle to interconnect the lead-in terminal connection and lead-out terminal connections of one and the same wire;

(f) the earth terminal being extended internally of said receptacle to constitute a support fitting secured to the terminal carrier plate, said earth terminal being soldered to said second pole means of the discharging means;

(g) said first pole means of the discharging means being soldered to said U links whereby the terminal carrier plate and the discharging means constitute a monobloc subassembly within the receptacle, and wherein, said discharging means comprises, an external shell, a metal cup joined to said said external shell, an electrically conducting fuse element within said cup and between said cup and said external shell, an electrode traversing said said cup but insulated from the cup, said fuse element comprising means responsive to heating of said discharge means during a discharge therethrough, for melting and flowing to short circuit said electrode to the metal cup.

* * * * *